US005284328A

United States Patent [19]

LaBate, II

[11] Patent Number: 5,284,328

[45] Date of Patent: Feb. 8, 1994

[54] CONSUMABLE CHARGE BOX AND ASSEMBLY FOR RECHARGING MATERIAL INTO A FURNACE OR VESSEL FOR PRODUCING MOLTEN METAL

[75] Inventor: Michael D. LaBate, II, East Palestine, Ohio

[73] Assignee: Insul Company, Inc., East Palestine, Ohio

[21] Appl. No.: 6,980

[22] Filed: Jan. 21, 1993

[51] Int. Cl.[5] ..... F27D 3/14

[52] U.S. Cl. ..... 266/196; 75/305; 266/272

[58] Field of Search ..... 75/305; 266/196, 272; 249/197

[56] References Cited

U.S. PATENT DOCUMENTS

| | | | |
|---|---|---|---|
| 152,326 | 6/1874 | Bushnell | 249/197 |
| 478,936 | 7/1892 | Kennedy et al. | 249/197 |
| 2,763,043 | 9/1956 | Grant | 249/197 |
| 3,158,911 | 12/1964 | Thompson | 249/197 |
| 3,165,798 | 1/1965 | LaBate | 249/197 |
| 3,212,749 | 10/1965 | LaBate | 249/197 |
| 4,121,805 | 10/1978 | LaBate | 249/197 |
| 4,186,908 | 2/1980 | LaBate | 249/197 |
| 4,262,885 | 4/1981 | LaBate | 266/196 |
| 4,350,325 | 9/1982 | LaBate | 266/196 |
| 4,471,950 | 9/1984 | LaBate | 266/272 |

*Primary Examiner*—Peter D. Rosenberg
*Attorney, Agent, or Firm*—Harpman & Harpman

[57] ABSTRACT

Containers formed of consumable materials of compatible chemistry with the remelting of molten metal are disclosed, the individual containers being capable of retaining molten metal having impurities and the like therein until the same is solidified and recharged into the furnace along with the individual consumable container.

12 Claims, 3 Drawing Sheets

CONSUMABLE CHARGE BOX AND ASSEMBLY FOR RECHARGING MATERIAL INTO A FURNACE OR VESSEL FOR PRODUCING MOLTEN METAL

BACKGROUND OF THE INVENTION

1. Field of the Invention

This invention relates to a charge box comprising a consumable container for use individually or in an assembly for receiving the final portion of a molten metal pour from a furnace or other vessel.

2. Description of the Prior Art

There are no known prior art devices.

U.S. Pat. No. 152,326 discloses wooden boxes forming molds embedded in sand, clay, or earthy materials.

U.S. Pat. No. 478,936 discloses molds formed of asbestos board in which steel ingots may be cast.

U.S. Pat. No. 2,736,043 discloses a consumable fiber liner for an ingot mold.

U.S. Pat. No. 3,158,911 discloses tubes formed of inorganic fibrous material positioned in ingot molds to receive molten metal from a ladle.

The remainder of the known prior art comprises a plurality of the present applicant's earlier U.S. patents relating to consumable hot tops for ingot molds and blast furnace runners as follows: U.S. Pat. Nos. 3,165,798, 3,212,749, 4,121,805, 4,186,908, 4,262,885 and 4,350,325.

Applicant's prior U.S. Pat. No. 4,471,950 relates to an expandable consumable stopper plug for steel making and handling vessels.

The present invention discloses a novel, expendable consumable charge box and assembly for recharging material into a furnace or a vessel for producing molten metal and where the charge boxes in the form of consumable containers are of a shape and size that enables the container and solidified molten metal therein to be picked up and charged back into the furnace for rapid remelting due to residual heat contained before total solidification of the final part of a molten metal pour has taken place.

SUMMARY OF THE INVENTION

An expendable consumable charge box capable of being used individually or in a circular assembly for receiving the final portion of a molten metal pour from a furnace or vessel and holding the same until the molten metal and the impurities therein have substantially solidified. The consumable charge box either as individually used or in the circular assembly is then picked up and charged back into the furnace for rapid remelting. The consumable charge box formed of consumable materials including lime and any combination of products that may be reduced in size by direct contact with the temperature of molten metal along with a binder such as sodium silicate and resins of all grades including those hereinafter set forth provides a safe and ecological method of handling of rechargeable solidified metal for any type of furnace or vessel used in producing molten metal and wherein the chemistry of the consumable container is ideal and compatible chemistry to the remelting of the molten metal.

DESCRIPTION OF THE PREFERRED EMBODIMENT

Figure 2:
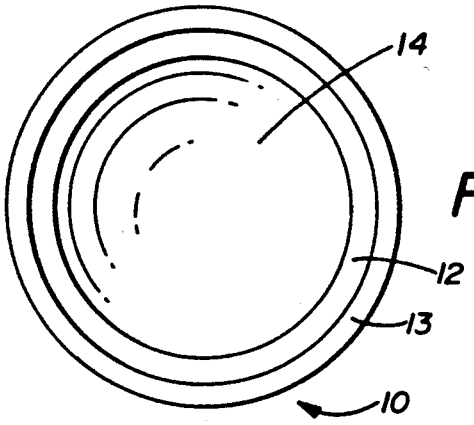
FIG. 2 is a top plan view thereof.
Figure 1:
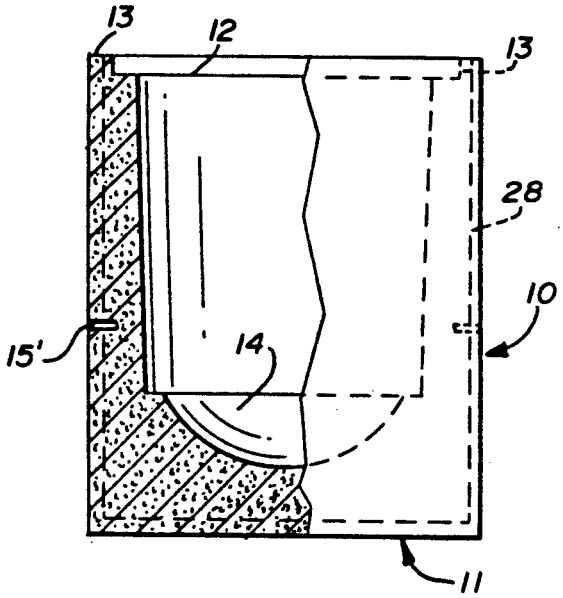
FIG. 1 is a cross sectional side elevation of a consumable charge box.

By referring to FIGS. 1 and 2 of the drawings, a cross sectional side elevation of one form of the consumable charge box of the present invention may be seen and referring thereto it will be seen that it comprises a cylindrical body 10 having a bottom 11 and a top 12. Part of the top 12 defines an upstanding annular rib 13 and it will be observed that the bottom 11 is thicker than the side walls which form the cylindrical body 10 and is preferably formed with a concave cavity 14 defining its innermost lower surface. When the final portion of a hot metal pour from a furnace or a vessel is of relatively small quantity, the charging box as illustrated in FIGS. 1 and 5 of the drawings may be conveniently used and when the molten metal with the usual impurities therein found in the final pouring from a furnace or vessel has solidified, the entire device may be easily picked up by a forklift truck and charged back into the furnace or vessel which eliminates much of the problem that has heretofore existed in handling the metal in such final pourings.

Those skilled in the art will recognize that the final pourings of metal from furnaces or other vessels has heretofore been simply poured on a floor, usually concrete and allowed to solidify and then cut up with torches into pieces which could be picked up and recharged into the furnace for rapid remelting.

Figure 4:
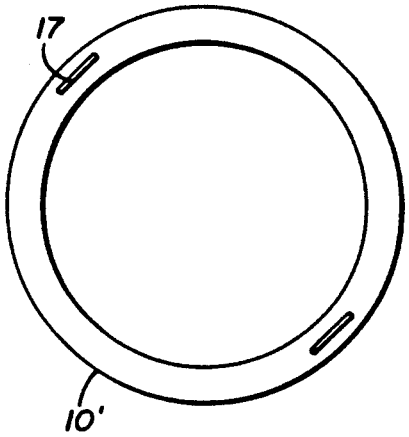
FIG. 4 is a top plan view thereof.
Figure 5:
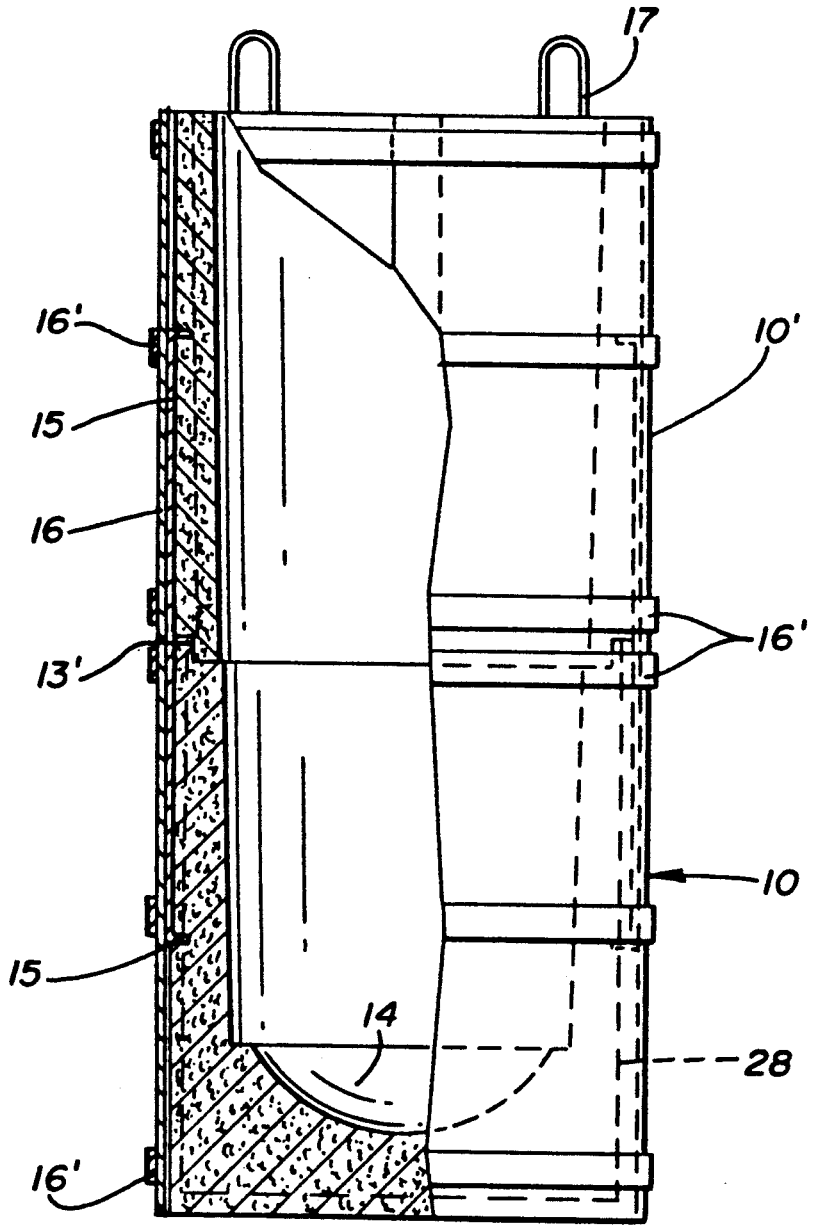
FIG. 5 is a cross sectional side elevation of an assembly of the units of FIGS. 1 and 3 and illustrating attachment bars and a metal sheath positioned around the units and supported thereby as a reinforcing element.

In the present invention, the materials of the cylindrical body of the charging box of FIGS. 1,2,3 and 4 and as illustrated in assembly in FIG. 5, are of a chemistry that is ideal and compatible with the chemistry of the remelting of the molten metal.

Figure 3:
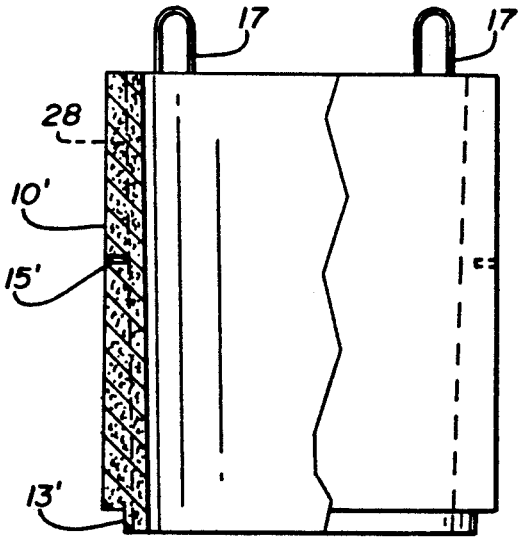
FIG. 3 is a cross sectional side elevation of a cylindrical wall section adapted to be engaged on the upper end of the charge box illustrated in FIGS. 1 and 2.

In FIG. 3, the cylindrical wall section 10' has an open bottom with a downturned annular rib 13' and slots 15' to receive hooked ends on attachment bars 15.

Referring now to FIG. 5, the devices of FIGS. 1 and 3 will be seen in assembled relation, one on top of the other, with attachment bars 15 holding the assembly, a steel plate sheath or shroud 16 holds the charging box in the assembly illustrated and all of it is then recharged into the furnace or vessel from which the final portion of the pouring of molten metal has been received and partially solidified.

The device of FIGS. 3 and 4 is provided with loops 17 which enable the same to be picked up by a crane rather than a forklift truck or the like.

Figure 6:
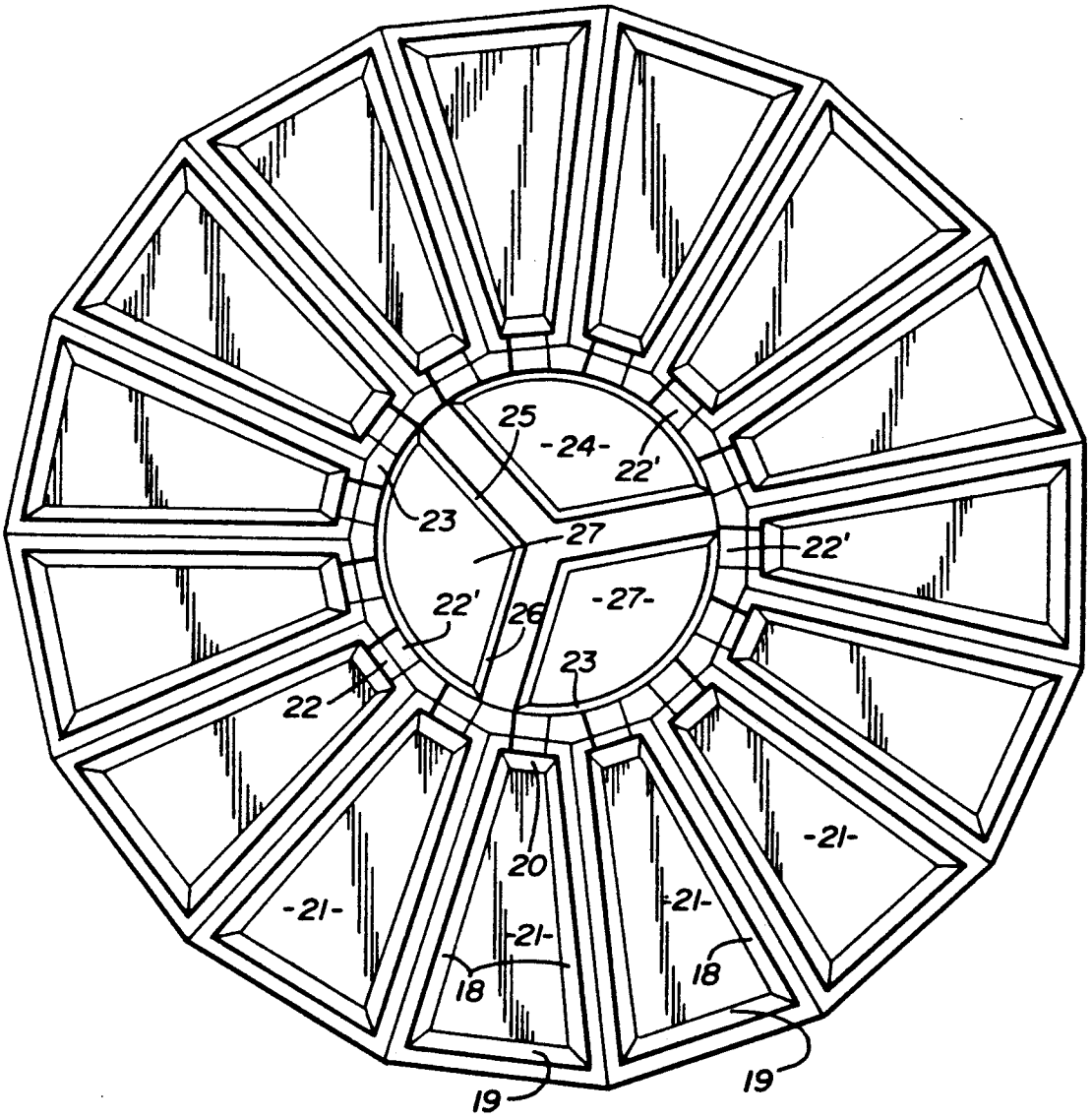
FIG. 6 is a top plan view of an assembly of suitably shaped charge boxes in a circular pattern.

By referring now to FIG. 6 it will be seen that the shape of the consumable charge box heretofore described in connection with FIGS. 1-5 of the drawings has been changed so that the box is an elongated modified semi-rectangular shape formed of a pair of spaced side walls 18, a first end wall 19, and a shorter end wall 20 and a bottom 21. An opening 22 is formed in the shorter end wall 20 of each of the plurality of consumable charge boxes illustrated in FIG. 5 in a circular pattern wherein the shorter end walls 20 of the consumable charge boxes are illustrated in a circular pattern engaging openings 22' in an arcuate side wall 23 which forms part of a molten metal receiving chamber 24 which has a bottom 27 and a pair of angularly disposed side walls 25 and 26 respectively joined to one another and the ends of the arcuate side walls 23. The walled molten metal receiving chamber 24 comprises a unitary construction of an overall shape comprising one-third of a circle, three of which are assembled in side by side full circular arrangement as illustrated in FIG. 6 of the drawings.

Each of the molten metal receiving chambers 24 of the three units chosen as an example in the present disclosure will be seen to communicate with five of the charge boxes formed of the walls 18, 19 and 20 and the bottom 21.

Each of the charge boxes formed of the walls 18, 19, 20 and bottom 21 is reinforced by steel strapping 16' to insure the retention of the shape of each of the consumable charge boxes when the same are picked up along with their substantially solidified metal content and recharged into the furnace or vessel from which the final pour received in the boxes was obtained.

The charge boxes may be formed with vertically straight side walls or downwardly and inwardly tapered side walls and flat bottoms and the openings 22 in the end walls 20 may be arcuate cutaway sections in the upper surfaces of the end walls 20 and the openings 22' in the upper surfaces of the arcuate walls 23 may be similar arcuate shapes so that molten metal and its impurities from the final pour will flow outwardly through these arcuate openings or channels 22 and 22' from the chambers 24 into the charge boxes formed by the side walls 18 and the first and second end walls 19 and 20 respectively. The charge boxes are formed in desired shapes, compacted to a desirable density and heat dried.

Interior reinforcing is not necessary in the charge boxes illustrated and heretofore described in connection with FIG. 6 but may be used and comprise welded wire mesh if desired and such welded wire mesh 28 is illustrated in the cylindrical side walls forming the cylindrical body 10 and the bottom 11 of the charge box in FIG. 1 of the drawings and in the cylindrical side wall of the vertical extension of the consumable charging box illustrated in FIG. 3 of the drawings.

The consumable materials of the consumable charge boxes of the invention are so formed as to withstand the large displacement force generated by the weight of the molten metal poured therein and the consumable mix from which the consumable charge boxes are formed can be made of the following materials: lime, limestone, slag, concrete, aluminum refractories, gravel, sand and any combination of products that will be reduced in size by direct contact with the temperature of molten metal.

The binders necessary in the consumable mix can be anyone of a series that can be used in consumable hot tops in the inventor's aforesaid U.S. patents and specifically sodium silicate, water glass, resins of all-grades, sulphite lye, pitch cement. A typical mix can comprise wood fibers, paper, and any and all matter that is consumable in molten metal. The percentages of the various materials vary greatly due to the size and shape of the consumable containers and are comparable generally with the materials and the ranges used in the inventor's aforesaid hot top patents and the like formed of materials consumable in molten metal.

For example, in applicant's U.S. Pat. No. 4,471,950 a typical and satisfactory analysis of the materials comprises silicon dioxide in an amount between 31% and 36% by weight calcium dioxide in an amount between 21% and 26%, aluminum oxide in an amount between 11% and 15% by weight, magnesium oxide in an amount between 3% and 6% by weight with the amounts of the several ingredients being sufficient to provide the necessary strength to the consumable charge boxes.

A further example of a typical and satisfactory analysis of the materials capable of being used in the present invention can be those set forth in applicant's earlier U.S. Pat. No. 3,165,798 wherein a desirable mix of the consumable materials is set forth as comprising a batch including 40 pounds of sawdust, 140 pounds of raw dolomite, 80 pounds of sodium silicate as a binder. This basic mixture may be altered by substituting an equal quantity by weight of small sized wood chips, rice hulls, or wheat kernels for the sawdust. A still further variation forming a suitable mixture comprises substituting sintered granulated blast furnace slag or finely ground fired clay (grog) for the raw dolomite in equivalent weight. It has also been determined that a resin urea-formaldehyde in the amount of 50 pounds by weight can be used as a binder rather than the 90 pounds of sodium silicate.

It will occur to those skilled in the art that a number of variations in the mix of the consumable material are therefore possible.

Applicant's prior U.S. Pat. No. 4,262,885 is directed to a prefabricated consumable blast furnace runner in which hot molten metal as from a blast furnace is conveyed to a desired point of discharge. The devices of the '885 patents are formed to withstand the heat and pressure of the molten metal and the '885 patent cites as an example a typical suitable mixture comprising 17% by weight wood chips or sawdust, about 61% by weight clay or dolomite and about 22% by weight a resin urea-formaldehyde or sodium silicate. The patent observes that the consumable combustible or disintegrable module can be produced with any type of phenolic resin or other glue or glue-like binders and the same would apply to the present invention.

From the foregoing it will be seen that the consumable charge boxes as disclosed for individual use in receiving the final portion of a pour of hot metal from a furnace, such as a blast furnace, are adaptable to the varying amounts of the final pour of metal which those experienced in the art will recognize contains the undesirable impurities along with usable molten metal. A typical final pour, such as the present invention is devised to receive for recharging, can hold several thousand pounds or more of the final pour of molten metal. Each of the plurality of consumable charge boxes as used in the circular assembly as hereinbefore described are capable of holding between 6000 and 7000 pounds of the molten metal of the final pour and by arranging the same in the circular pattern as hereinbefore described, greater amounts of metal can be easily directed into the several consumable charge boxes in the disclosed assembly so that regardless of the amount of such a final pour of metal, the present invention is easily capable of accommodating the same and providing a consumable container with the end pour of metal in substantially solidified state that can be individually charged or recharged into the furnace or other vessel from which the final pour was made.

It will also be observed that the formation of the consumable charge boxes and their ability to be assembled enables them to be conveniently packaged and shipped to the customer by usual refractory transportation means.

Practical experience with the invention by Insul Company, Inc. with several plants in the U.S. serving the steel industry and others, have proven the cost savings and time savings advantages of the invention due primarily to the versatility of the invention and its ability to be adapted to various quantities of end pour molten metals and holding the same for solidification and then providing a convenient and quick way of recharging both the consumable charge boxes and their contents to the furnace thereby avoiding the heretofore costly and time consuming practice of pouring end pour volumes of molten metal on a floor and awaiting the solidification of the same and then cutting up the solidified end pour metal with torches to enable it to be recharged to the furnace.

Although but two embodiments of the present invention have been illustrated and described, it will be apparent to those skilled in the art that various changes and modifications may be made therein without departing from the spirit of the invention or the scope of the appended claims and having thus described my invention, what I claim is:

1. A charge box for receiving, holding and recharging material from a molten metal furnace into said molten metal furnace comprising a container having a bottom and upstanding sidewall therein, said sidewalls are of a known thickness and said bottom is of a thickness greater than that of said sidewalls, said charge box is a solid shape of consumable material of a known density having a predetermined lifetime determined by said density and combustibility of said consumable material, when said charge box is in contact with molten metal.

2. The charge box set forth in claim 1 and wherein said upstanding side walls are parallel.

3. The charge box set forth in claim 1 and wherein said upstanding walls are sloped inwardly and downwardly toward said bottom.

4. The charge box set forth in claim 1 and wherein said consumable material consists essentially of about 17% by weight sawdust, 61% by weight limestone, and 22% by weight sodium silicate.

5. The charge box set forth in claim 1 and wherein said consumable material comprises essentially of about 17% by weight paper pulp, 61% by weight limestone, and 22% by weight resin as a binder.

6. A charge box for receiving, holding and recharging materials from a molten metal furnace into said molten metal furnace comprising a container having a bottom and upstanding sidewalls wherein said charge box is a solid compact heat dried shape of consumable material of a known density having a pre-determined lifetime determined by said density and combustibility of said consumable material when in contact with molten metal.

7. The charge box set forth in claim 2 and wherein said upstanding walls are parallel.

8. The charge box set forth in claim 2 and wherein upstanding walls are sloped inwardly and downwardly towards said bottom.

9. The charge box set forth in claim 2 and wherein said upstanding sidewalls are cylindrical.

10. The charge box set forth in claim 2 and wherein said upstanding sidewalls comprises two stackable cylindrical sections, one of which is engageable on said bottom.

11. The charge box set forth in claim 2 and wherein said consumable material consist essentially of about 17% by weight sawdust, 61% by weight limestone, and 22% weight sodium silicate.

12. The charge box set forth in claim 2 and wherein said consumable material comprises essentially of about 17% by weight paper pulp, 61% by weight limestone and 22% by weight resin as a binder.

* * * * *